United States Patent [19]

Pauliukonis

[11] Patent Number: 4,667,780

[45] Date of Patent: May 26, 1987

[54] RE-CHARGEABLE SERVO CYLINDER

[76] Inventor: Richard S. Pauliukonis, 6660 Greenbriar Dr., Cleveland, Ohio 44130

[21] Appl. No.: 714,967

[22] Filed: Mar. 22, 1985

[51] Int. Cl.[4] ..... F16F 9/32

[52] U.S. Cl. ..... 188/300; 188/317; 188/319; 188/322.21; 92/170

[58] Field of Search ..... 188/299, 300, 312, 313, 188/316, 317, 319, 322.21; 92/170

[56] References Cited

U.S. PATENT DOCUMENTS

| | | | |
|---|---|---|---|
| 1,294,014 | 2/1919 | Worster | 137/533 |
| 2,912,002 | 11/1959 | Miller | 137/541 |
| 3,177,980 | 4/1965 | Porter | 188/319 |
| 3,343,833 | 9/1967 | Fader | 188/313 |
| 3,359,802 | 12/1967 | Sollenberger | 188/313 |
| 3,420,341 | 1/1969 | Keehn, II | 188/319 |
| 3,762,514 | 10/1973 | Freitag | 188/300 |
| 3,920,253 | 11/1975 | Bauer | 188/313 |
| 4,036,335 | 7/1977 | Thompson | 188/319 |
| 4,113,220 | 9/1978 | Godwin | 188/300 |
| 4,257,582 | 3/1981 | Wirges | 188/300 |
| 4,526,088 | 7/1985 | Reuschenbach | 188/317 |
| 4,570,669 | 2/1986 | Pauliukonis | 137/528 |

FOREIGN PATENT DOCUMENTS

| | | | |
|---|---|---|---|
| 118138 | 4/1900 | Fed. Rep. of Germany | 137/528 |

*Primary Examiner*—Abraham Hershkovitz
*Attorney, Agent, or Firm*—R. S. Pauliukonis

[57] ABSTRACT

A re-chargeable self-contained servo cylinder for the control of force with variable piston positions under load includes an elongated cylinder housing having a tubular body with open receiver end and closed opposite end by a cap which includes a central port provided with integral directional check valve for supply of working fluid under pressure during cylinder charging, a piston and rod assembly slidably received inside the cylinder including a rod end closure with seals slipped over piston rod and secured inside the open receiver end so as to protrude an end portion of the piston rod for attaching to a load carrying platform, an integral flow control valve with control rod inside an elongated central bore of the piston rod for control of working fluid communication between the sides of the piston via a fluid opening provided therein when cylinder becomes pressurized by the working fluid and for maintaining a given piston position inside cylinder fixed when the flow control valve is closed thereby also fixing the length of piston rod protrusion until control rod becomes moved externally to open flow control valve internally for restart of fluid flow between the piston sides with axial piston travel within the stroke limitations provided by the cylinder when piston rod position change is desired.

10 Claims, 4 Drawing Figures

RE-CHARGEABLE SERVO CYLINDER

The prevent invention relates to fluid power components generally and to closed-loop servo cylinders specifically.

In particular, the present invention pertains to a linear actuator energized either hydraulically or pneumatically by a working fluid under pressure in a self-contained rechargeable system that employs tubular housing as fluid reservoir comprising of two fluid chambers separated by a piston with appropriate seals therebetween to maintain fluid pressure therein so as to either lock piston and rod assembly in a selected axially variable position or to permit axial motion within the stroke limitations provided in order to find it's own position, consistent with closed-loop servo system operation. Such servo cylinders normally operate with integrated circuits and rarely are rechargeable self-contained units. In turn, all servo cylinders of the present state of the art are extremely complicated and costly.

The present invention provides a servo cylinder of this general type which is simple in design, and hence low in cost, and reliable in operation. One aspect of the invention makes possible the utilization of simple unidirectional check valve in the cylinder blind end provided with a port for cylinder charging, be it an all metal or an all plastic servo cylinder.

Depending on the magnitude of forces, speeds and strokes including other parameters that may influence the selection of such cylinders, the ultimate choice of materials of construction can always be based on the minimum fabricating cost for a given cylinder design. The integration of the check valve into the cylinder charging port permits the utilization of injection and pressure molding with thermosetting or thermoplastic materials or a combination thereof with equal success as making such cylinders by conventional techniques from metal. However, producing servo cylinders from plastics multiplies the advantages of the present invention considerably. It provides means for integrally molding at least one end cap with the cylinder body in one operation. It also enables production of an all-plastic one-piece piston rod assembly drastically cutting down the manufacturing cost of such piston assembly. In another embodiment, the piston rod assembly may be of a rubber-plastic composition wherein the piston is of rubber while the rod is of plastic. Or it may be that such composite piston rod construction is employed with a metal housing. Or a metallic gland serving as rod end closure may be preferred is some applications since such glands are already in use with metal cylinders as standards. In some cases it may be imperative to use metal cylinder with plastic piston rod assembly, in particular in large force and velocity applications requiring high pressures for load position change.

It is obviously desirable to provide servo cylinders of this type which are not too complicated and perform superior function in service at less cost.

Further, the cylinder re-charging provision makes it possible to use the same cylinder design for a plurality of applications. By simply charging cylinder with a working fluid of higher pressure changes the cylinder classification, a task impossible with servo cylinders of prior art, factory precharged with fixed pressure for fixed force and velocity application and not otherwise, in particular if the force must be slightly augmented for better results in the field. In turn, logistics are greatly improved with the servo cylinder of the present invention at practically no cost.

These and other objects and advantages of the invention will become more fully apparent from the following description of an embodiment of the invention, taken together with the accompanying drawings.

IN THE DRAWINGS

Figure 1:
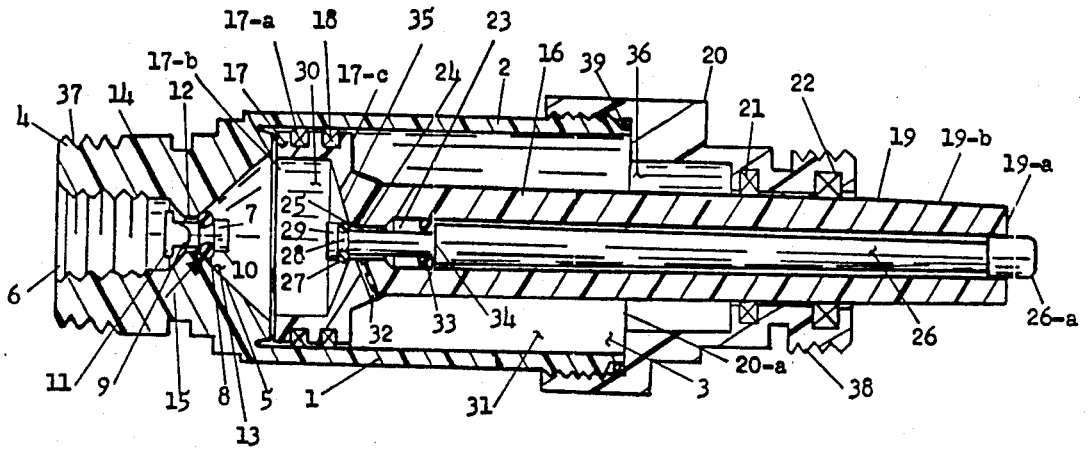
FIG. 1 is a cross sectional view of a typical all plastic servo cylinder identifying pertinent structural details.

Shown in FIG. 1 is an all plastic one-piece molded cylinder housing 1, having a tublar body 2 with open receiver end 3 and closed opposite end with integrally molded end cap 4 which is formed and provided with substantially conical inner face 5. In the end cap 4 a central port 6 for supply of working fluid under pressure during cylinder charging is provided with an integral floating check valve 7. A seal 8 secured to a stem 9 provided with a larger head 10 at one end and a flattened large tee 11 at another stem end of check valve 7 is shown abutting face 5 of cap 4 when the valve 7 is closed due to internal pressure effect after charging the cylinder which when disconnected from fluid supply source becomes a self-contained energized servo unit. During cylinder charging, however, seal 8 will float away from face 5 along with stem 9 as far as the tee 11 will permit when subjected to pressure of the working fluid supplied to port 6,rendering valve open. Disconnecting port 6 from the source of supply of the working fluid renders valve automatically closed due to the directional change of fluid flow, making check valve 7 unidirectional device of simple design. In fact, stem 9 can be inserted without seal 8 through port 6 so as to have head 10 pass end opening 12 into a first fluid chamber 13 at the cylinder blind end 14 far enough to place seal 8 from open receiver end 3 over head 10 during check valve 7 assembly into the housing 1 prior to placing piston and rod assembly thereto. Due to the angular configuration of face 5, the force vector acting over seal 8 is downward, towards the inside corner of head 10 marked by arrow 15 when valve 7 is closed, legitimizing the structural integrity of such simple check valve design, because if the face 5 were not on an angle, seal 8 could be easily unseated from stem 9 under pressure due to force direction otherwise acting parallel to the axis of heat 10. It is not to say that in some high pressure and force applications head 10 may have to be enlarged beyond the size of opening 12 so as to command the use of two piece check valve construction. This could be easily accomplished by separating stem 9 with head 10 from the tee 11 initially until final assembly inside opening 12 is performed placing the seal 8 over stem 9 against large head 10 first before inserting from the receiver end 3 to meet tee 11 inserted via port 6 for final assembly. Large head two piece design would insure sealing capability of the check valve 7 irrespective of the construction and configuration of end cap 4 as well as the magnitude and the direction of the forces prevailing. Since the majority of the servo cylinder applications fall into low to moderate pressure and force ranges, extensive tests with one piece stem 9 shown in FIG. 1 and FIG. 2 proved conclusively that the design of check valve 7 is more than adequate for purpose intended, in particular that the seal 8 of O-ring configuration shown can easily be replaced with a seal of rectangular configuration cut out from an elastomer tubing of dimensions needed (not shown) when so indicated by an application subject to seal improvement. Port 6 may also be closed by a plug per FIG. 2.

An all plastic one-piece molded piston and rod assembly 16 of FIG. 1 is comprised of piston 17 including appropriate grooves 17*a* for piston seals 18, and a piston rod 19. With the cylinder receiver end 3 open, the piston rod assembly 16 is slidably inserted into tubular body 2 of cylinder 1. Rod end 20 provided with seals 21 and 22 is slipped over piston rod 19 for subsequent securing permanently in the receiver end 3 with seal 39 thereby completing the cylinder assembly. This cylinder alone serves as novel conventional actuator except for the check valve 7 which obviously would be omitted from the end cap 4 in conventional actuator but added as mandatory to re-chargeable servo cylinders of the present invention incorporating check valve plus flow control means so as to enable closed-loop servo system operation, typical to servo cylinders. In turn, central to piston 17, at an inner end of a a bore 23 of piston rod 19, FIG. 1 shows an integral flow control valve means 24 for control of fluid flow between piston sides 17*b* and 17*c* respectively via a central fluid passage 25 exhausting into the first fluid chamber 13 at the cylinder blind end 14. When control rod 26 is depressed externally at the end 26-*a* to unseat internal seal 27 secured inside a groove 28 adjacent rod end head 29 spaced inside a counterbore 30 of piston 17, working fluid can circulate between a second fluid chamber 31 comprising an annular space formed by piston rod 16 and tubular body 2 and a first fluid chamber 13 at the cylinder blind end 14 via an opening 32 leading to central fluid passage 25 thereby establishing closed-loop system that permits unit operation. A seal 33 spaced inside bore 23 against a rod shoulder 34 of control rod 26 insures that the working fluid never leaves the fluid reservoir comprised of the two fluid chambers 13 and 31 respectively after the cylinder becomes energized hydraulically or pneumatically at selected pressures determined by applicational needs, speeds and forces. However, since the seal 27 adjacent rod end head 29 is purposely made of a size smaller than the seal 33 inside bore 23, the size differential produces different end forces due to the working fluid pressure inside bore 23. Since the end force over seal 33 is larger than the end force over seal 27, the integral flow control valve means 24 automatically stays closed with seal 27 pressing against a conical piston face 35 inside counterbore 30 until the rod end 26-*a* in effect is depressed by a larger external force in the direction opposite to the direction the end force over seal 33 acted to establish fluid communication between the sides of the piston 17*b* and 17*c* respectively. Conversely, when the flow control valve means 24 is closed, the piston and rod is locked in a given position because of no fluid communication between piston sides is permitted. However, when the control rod 26 becomes activated by pressing on the rod end 26-*a*, the piston and rod can be moved inside the piston proper due to the fluid flow between piston sides via fluid passages provided therein until the external force becomes removed to automatically render flow control valve means 24 closed. Simultaneously the axial movement of piston and rod inside the servo cylinder stops at a position which is infinite between the maximum and minimum stroke limitations.

In operation, with piston rod re-tracted as shown in FIG. 1 the flow control valve means 24 is also closed, without any movement of the piston and rod assembly 16 until rod rod end 26-*a* is depressed opening fluid communication through the valve and starting to extend the piston rod 19 for as long as the rod end 26-*a* stays depressed and until piston 17 completes the stroke abutting a face 20-*a* of rod end 20. This travel is automatic due to an end force developed by the working fluid pressure over the piston side 17-*b* equivalent to pressure times cross sectional area of piston rod 19. For example, if piston rod is of 1" diameter having 0.78 $in^2$ surface area, and if the cylinder was charged with a 100 psig working pressure, be it hydraulic or pneumatic, the end force of 78 lbs will always be present when the flow control valve means 24 become open so as to permit flow of the working fluid from chamber 31 to enter chamber 13 as a result of the piston travel caused by the end force prevailing. As stated before, the axial piston travel inside tubular body 2 can instantly be stopped when the flow control valve 24 becomes closed which takes place also automatically when the force from control rod end 26-*a* becomes removed prior to completing full stroke, or it may be restarted again to complete the stroke or, if the force to the rod end 19-*a* exceeds the driving force of 75 lbs, the direction of piston travel inside the cylinder can be reversed so as to return the piston back into original position shown in FIG. 1, and vice-versa. This type of servo cylinder design is therefore ideal for applications in chair column assemblies wherein the chair seat weighing circa 50 lbs can be lifted up to a maximum height permitted by the stroke. After adding body weight to it when seated such person can lower the seat to any other position downward he may select as a result of the total external force which is larger than the internal force of the working fluid over piston rod of a specific servo cylinder. This is done by activating the protruding end of the control rod so as to open integral flow control valve that permits closed-loop servo system operation in accordance with the preceding description. Locking of piston and rod assembly in any selected axial position inside the cylinder takes place when working fluid is prohibited from communicating between the piston sides. In turn, piston becomes locked in a fixed position by the working fluid from both sides until the communication becomes established across the piston sides urging piston motion inside cylinder in the direction where least resistance prevails as a result of dominant force-action previously described. It should be emphasized here that for non-compressible working fluid the fluid chambers 13 and 31 must be sized equally in order to complete the stroke shown in FIG. 1. For this purpose it was necessary to incorporate a long counterbore 36 into rod end 20 of FIG. 1 acting as a compensator of volumes, since volume of chamber 13 is always longer than the volume of chamber 31 that has to accomodate the piston rod 19 during the piston position change inside tubular body 2 in operation. Using compressible working fluid such as air or carbon dioxide or the like the need for compensator of volumes becomes academic, and as such rarely used with servo cylinders which often are called gas cylinders. Gas cylinders in effect are preferred due to the cushion effect they provide because of the inherent compressibility of the gases serving as working fluids. In turn, more and more gas cylinders appear on the market for use not only in seating adjustment of chair columns, but also in applications such as high-low beds, operating tables and even in automotive industry. Many untapped applications necessitated consideration of servo cylinders produced from metal, in paritcular with cylinder re-charge capability using non-compressible hydraulic fluids at high pressures for cylinder charging.

Figure 2:
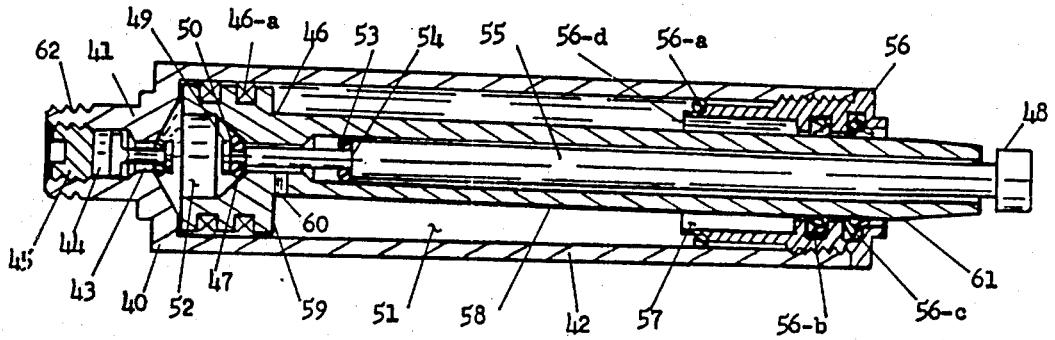
FIG. 2 is a cross section of identical servo cylinder in metal with gland modified.

FIG. 2 identifies such servo cylinder produced from metal. As can be seen from FIG. 2 in cross section, except for a few details, the servo cylinder illustrated is identical in construction and operation to that of FIG. 1.

The servo cylinder of FIG. 2 is comprised of a cylinder housing 40 which may be produced in one piece by forging or casting with an end cap 41 integral or it may be fabricated by conventional methods from two separate pieces wherein a tubular body 42 is connected to cap 41 by threads or tie rods using seals therebetween (not shown). FIG. 2 shows an integral floating check valve 43 inside central fluid supply port 44 which is closed by a plug 45 after cylinder is charged for protection against tampering with check valve 43 to insure long life of the cylinder in service due to this redundance in double sealing from leaks. A piston and rod assembly 46 with seals **46-*a* and a flow control valve means 47 terminating with external control rod end 48 is also shown in FIG. 2. Opposite to rod end 48 an internal rod head 49 with a seal 50 controls fluid communication between piston sides exposed to fluid chambers 51 and 52 respectively. A seal 53 at an internal rod shoulder 54 of actuating rod 55 of a size larger than the size of seal 50 insures that the flow control means are automatically closed due to the force differential induced by the working fluid in accordance with the preceding description while discussing details of FIG. 1. End closure 56 which is nothing more than a conventional rod gland modified to incorporate a volumetric compensator 57 provided with seals of which an O-ring seal 56-*a* protects the tubular body 42 from leaking while seal 56-*b* may be an O-ring or a U-cup to protect a hollow piston rod 58 from leaking along with additional seal 56-*c* which also serves as a rod wiper to maintain the protruding piston rod 58 clean during the cylinder operation completes the assembly of this actuator. In operation, the conditions are identical to those already discussed when describing FIG. 1 operation, except for the requirement to properly proportion volumes of chambers 51 and 52 so as to benefit from total provision of stroke which in FIG. 2 starts with an end 56-*d* of gland 56 and continues along the axial length of tubular body 42 up to and until reaching a piston 59, adjacent which is opening 60 for fluid communication. Provisions for load attachment means to the servo cylinder of the present invention in applications include many options. Application of thrust bearings to either end of the servo cylinder of FIG. 1 provided with threads 37 and 38 respectively can be employed if desired or a load carrying platform may be attached to an external taper 19-*b* of piston rod 19 of FIG. 1. Likewise in FIG. 2 an external self-locking taper 61 formed over protruding section of piston rod 58 may servo as a first cylinder anchor point for a platform of a chair or the like (not shown) provided with a mating taper while the end cap 41 provided with threads 62** may serve as a second anchor point for attaching the servo cylinder of the present invention directly or through a thrust bearing into a system requiring height adjustment without the use of external circuitry for supply of the working fluid.

Figure 3:
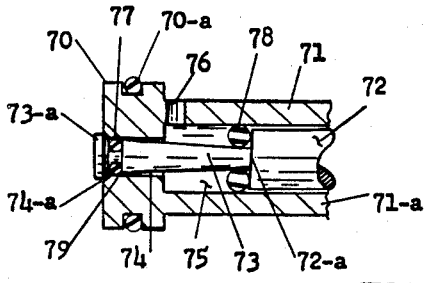
FIG. 3 is a piston and rod assembly in section with modified valving for high pressures.

FIG. 3 represents a modified flow control valve means adaptable to FIG. 1 and FIG. 2 as well in that it shows in a greater detail the valving means in general and means for metering flow across the piston to facilitate speed control means for axial piston travel inside the cylinder in particular, including a modified disposition of the valving means that may be preferred in high pressure applications. In FIG. 3 a piston head 70 having a single peripheral seal **70-*a* is provided with a hollow piston rod 71 which is sectioned together with a concentric control rod 72 terminating at a shoulder 72-*a* with a tapered valving stem 73 of the valving means also shown in FIG. 1 and FIG. 2. Piston head 70 includes an inwardly extending small diameter central fluid passage 74 entering a larger diameter central bore 75 of a hollow piston rod 71 for communication of the working fluid with a perpendicular side hole 76 adjacent head 70 passing a wall 71-*a* of piston rod 71. Stem 73 is provided with a stem head 73-*a* of a size larger than the size of passage 74. A peripheral seal 77 adjacent head 73-*a* enters passage 74 together with stem 73 to render valve closed automatically due to an end force exerted by the working fluid over larger seal 78 spaced adjacent shoulder 72-*a*, in accordance with the preceding description. In FIG. 3 the head 73-*a* will be seated inside a chamber 74-*a* of fluid passage 74 to structurally and physically sustain the heavier load high pressure applications of valving means 79 experience in contrast with FIG. 1 and FIG. 2 light duty service wherein seals 27 and 47 respectively carry the end load alone. However, the tapered stem 73 of FIG. 3 when used in FIG. 1 and FIG. 2 will insure the often needed speed control of the piston inside cylinder by virtue of metering capability of the flow through passage 74 allowing more flow to pass along the taper when control rod 72 pushes stem 73** therethrough to extend more while protruding into the blind cylinder end during the actuation thereof.

Figure 4:
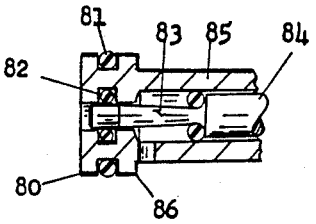
FIG. 4 is a piston and rod assembly in section with optional valving means.

FIG. 4 identifies an optional valving means with piston head 80 including a single peripheral seal 81 and an internal seal 82 for control of fluid flow between piston sides by a tapered axially movable stem 83 of a control rod 84 inside piston rod 85.

It should be noted here that the piston and rod assembly 86 of FIG. 4, like that of FIG. 3, can be employed with linear actuators that convert pressure energy of the working fluid into a linear motion of the present invention described and shown in FIG. 1 and FIG. 2 with equal success.

The choice of valving means is optional and can be selected from those identified in FIG. 1, FIG. 2, FIG. 3 or FIG. 4, depending on applicational requirements that control basic selection parameters such as speed, force and position, coupled with associated characteristics such as corrosion resistance, lubrication, including materials of construction in order to result in a least costly operational unit.

It can be stated without hesitation that the servo cylinder of the present invention offers many advantages, of which the provision for cylinder re-charge in the field predominates. In fact, there is no cylinder on the market that can be field maintained. The capability of converting a given unit with fixed stroke and force range into another selected stroke by placing inserts into the tubular body, if need be, or by repressurizing the servo cylinder with either gas such as compressed air or carbon dioxide or liquids such as hydraulic oils or a combination of gas-liquid as a working fluid under pressure of a magnitude the construction permits is contributory to the state-of the art in servo cylinders. Force, stroke and speed control with servo cylinder shown in FIGS. 1-4 and described in the foregoing specification meets the objectives set forth by this invention.

Although a preferred embodiment of this invention is disclosed, it is to be understood that various modifications and rearrangements of parts may be made without departing from the scope and the spirit of the invention disclosed and claimed herein.

What is claimed is:

1. A Servo Cylinder comprising:

an all plastic one-piece molded cylinder housing with a bore passing therethrough from a first end which is open and adaptable to be closed by a removable all plastic one-piece first end closure member including seals for preventing cylinder leakage, to a second end which is closed by an integrally molded second end closure member forming a blind end thereof having an inwardly extending coaxial fluid supply port means provided with an integral unidirectional check valve means incorporated therein for cylinder charging with pressurized working fluid, an all pastic one-piece piston having a piston head closely fitting and axially movable along said bore, said piston including an integrally molded hollow piston rod extending from said piston head through said first closure member, said first member including an inner end wall extending inwardly from said housing toward the axis of said bore to a first axially extending passage substantially around said piston rod coaxially forming a counterbore therein with substantial annular clearance therebetween, said first closure member also provided with a second passage extending from said first passage through which said piston rod extends with close fit, seals inside annular grooves spaced intermediate the ends of said second passage of said first end closure member for preventing leakage of fluid along said second passage while permitting axial movement of said piston rod through said closure member, said piston rod extending from said piston head a sufficient distance to insure that it enters said second passage when said first closure member is first engaged, said piston sealably dividing said bore into two separate fluid chambers each facing a side of said piston head, a fluid passage means between said fluid chambers across said piston starting and exiting at said piston sides, a valving means in said piston for control of fluid communication between said fluid chambers via said fluid passage means centrally spaced inside said piston head and coaxial with said hollow piston rod, including a control rod means interconnected with said valving means inside said hollow piston rod so as to actuate said valving means, said valving means maintained normally closed by a said pressurized working fluid after cylinder is charged, and when said valving means is urged to open by said control rod means, said piston can be axially moved inside said bore, and when said valving means is closed, said piston becomes fixed in a position selected from an infinite number of positions said piston with said piston rod can assume inside said bore traveling axially therein within the limits provided by the stroke, means for automatic valve closing by a working fluid force that is constanty acting over a surface of said control rod means in a direction opposite to the direction of rod actuating force which when reapplied to said control rod means will urge again piston position change, and vice-versa.

2. A servo cylinder as in claim 1 wherein said first closure member includes an annular volume compensator formed between a counterbore thereof and said piston rod, said counterbore extending outwardly from an inner edge of said closure partway toward the end of said piston rod terminating with a shoulder adjacent said piston rod seals incorporated into an axially extending passage of said first closure member.

3. A re-chargeable servo cylinder comprising:

a totally enclosed cylinder having a cylinder bore extending lengthwise thereof from a first end which is closed by an end cap provided with an integral unidirectional check valve means in a central fluid supply port thereof for cylinder charging with working fluid supplied thereto under pressure, to a second end which is open and adaptable of being closed by a hollow piston rod entering an end closure means, a piston having a piston head with a seal closely fitting and axially movable along said bore, said piston including said hollow piston rod extending from said piston head through said rod end closure means provided with piston rod seals for preventing leakage of fluid therebetween while permitting axial movement of said hollow piston rod therethrough, means for cylinder discharging via said check valve means when desired, an integral flow control means in said piston rod including a valving means in the center of said piston head interconnected with a control rod means extending from said piston head through said hollow piston rod outwardly to actuate said valving means, two fluid chambers separated by said piston in said bore of said cylinder first and second ends each adaptable of maintaining working fluid under pressure, fluid communication means in a closed-loop system between said fluid chambers via passages incorporated into said flow control means including means for cylinder operation by said control rod means, means for energizing said cylinder and said fluid chambers by working fluid via said unidirectional check valve means initially and for operating said servo cylinder subsequently so as to either maintain said piston and rod in a fixed axial position by the working fluid inhibiting motion from piston sides in each respective fluid chamber or to permit axial piston and rod motion within stroke limitation provided therein when said control rod becomes actuated externally to open said valving means for fluid communication between said fluid chambers, including means to serve a given application through cylinder re-charging so as to satisfy the service force requirements with infinite piston rod position adjustment means during piston travel along said cylinder bore, said valving means including a first elastomer seal spaced inside a groove incorporated therein at the piston head and a first innermost end of said control rod provided with a short reduced diameter section thereof extending inwardly therein so as to render a bubble-tight valve until said control rod is actuated, a second elastomer seal adjacent a shoulder of said reduced diameter section in said control rod inside said hollow piston rod, said second seal of a size slightly larger than the size of said first seal to insure a larger end force when subjected to the working fluid pressure than the end force exerted over said first seal thereby facilitating an automatic valve closing means of said valving means to maintain piston position locked until said control rod becomes actuated, and when said control rod is actuated, said first innermost end of said control rod becomes shifted from a first bubble-tight closed position of said valving means to a second valve open position facilitating fluid communication between said piston sides with associated piston motion within stroke limitations provided therein by said fluid chambers, and when said control rod actuation stops, said valving means returns to a first valve bubble-tight closed position automatically, and vice-versa, said check valve means including a floating tee-shaped stem provided with a seal so as to comprise a springless valve adaptable of cylinder charging and re-charging in the field.

4. A servo cylinder as in claim 3 wherein said means for cylinder operation includes piston speed control means incorporated into said valving means and comprising a tapered stem interconnected with said control rod so as to control the amount of fluid flow between said fluid chambers regulating axial piston motion along said housing bore wherein when said tapered stem is moved inside a fluid passage communicating between said chambers the flow passage changes proportionally to the stem location therein.

5. A linear actuator comprising:

an all plastic one-piece molded cylinder housing with a bore passing therethrough between the ends thereof of which a first end is closed by an all pastic one-piece first end closure means and a second end is closed by an integral second end closure means including an inwardly extending coaxial fluid supply port incorporated therein in the center thereof, said fluid supply port including an unidirectional check valve provided with a seal secured to a tee-shaped stem adaptable of floating away into opposite directions during cylinder charging and recharging operations at pressures that meet the service force requirements best, an all plastic one-piece molded piston and rod assembly having a piston closely fitting and axially movable along said bore, said piston including an integral hollow piston rod extending from a piston head through one of said end closure means, and means for moving said piston and rod assembly inside said bore axially between said housing ends defining a stroke thereof, a fluid reservoir in said bore comprising two fluid chambers separated by said piston provided with a peripheral sealing means including a fluid communication means between said fluid chambers and a flow control means incorporated therein, said flow control means including a control rod positioned centrally inside said hollow piston rod so as to have a first end thereof protrude a first piston rod end slightly for rod actuation externally while a second end of said control rod extends inwardly into said piston head terminating therein with an integral valving means for control of fluid flow between said fluid chambers, said valving means including a first seal of a size slightly smaller than the size of a second control rod seal spaced therein against a shoulder thereof inside said hollow piston rod, a perpendicular fluid port between said seals, said second seal while preventing fluid leakage along said control rod permits an automatic closing of said valving means due to a fluid force acting over said control rod seal by a magnitude slightly larger than the force exerted over said first smaller size seal, means for axial piston travel within selected positions therein and means for locking said piston by the working fluid from piston sides facing said fluid chambers in any position desired along the cylinder axis within the stroke limitations, said valving means further including a taper extending from said second end of said control rod into a central fluid passage of said piston head between said seals, said first seal adaptable of maintaining said valving means bubble-tight shut until said control rod is depressed from outside to initiate fluid communication between said chambers via said fluid passage at flows permitted by said taper thereby regulating speed of axial piston travel inside said cylinder.

6. A linear actuator as in claim 5 wherein said piston head is contoured and provided with a conical face on a first piston side.

7. A linear actuator as in claim 5 wherein said fluid supply part includes a a conical face inside said cylinder bore end provided with a check valve means for cylinder charging.

8. A linear actuator as in claim 5 wherein said extends from said second end of said control rod into a fluid passage provided in the center of said piston head terminating with an integral head of a size that permits axial movement thereof inside said fluid passage provided with an internal seal substantially central to said piston head.

9. A linear actuator as in claim 5 wherein said taper regulates amount of fluid exhange between said fluid chambers controlling axial piston motion along said housing bore wherein when said taper is axially moved inside said fluid passage of said piston head, the flow passage therethrough is changed depending on the taper position inside thereof passage thereby inducing flow changes in proportion to taper location therein to result in speed control of piston motion along said bore.

10. A linear actuator as in claim 5 wherein said means for moving said piston and rod assembly includes a valving means incorporated into said piston head provided with fluid passage means between piston sides thereof.

* * * * *